US005525861A

United States Patent [19]

Banno et al.

[11] Patent Number: 5,525,861

[45] Date of Patent: Jun. 11, 1996

[54] DISPLAY APPARATUS HAVING FIRST AND SECOND INTERNAL SPACES

[75] Inventors: Yoshikazu Banno, Ebina; Kohei Nakata, Machida; Ichiro Nomura, Atsugi; Tetsuya Kaneko, Yokohama; Naoto Nakamura, Isehara, all of Japan

[73] Assignee: Canon Kabushiki Kaisha, Tokyo, Japan

[21] Appl. No.: 54,308

[22] Filed: Apr. 30, 1993

[51] Int. Cl.[6] ..... H01J 1/54

[52] U.S. Cl. ..... 313/495; 313/252; 313/497; 313/553; 417/48

[58] Field of Search ..... 313/495, 553, 313/497, 545, 309, 244, 252; 417/48, 51

[56] References Cited

U.S. PATENT DOCUMENTS

| | | | |
|---|---|---|---|
| 3,408,532 | 10/1968 | Hultberg et al. | 315/12 |
| 3,935,499 | 1/1976 | Oess | 313/413 |
| 4,341,980 | 7/1982 | Noguchi et al. | 313/495 |
| 4,451,758 | 5/1984 | Watanabe et al. | 313/495 |
| 4,954,744 | 9/1990 | Suzuki et al. | 313/309 |
| 5,256,937 | 10/1993 | Bubeck et al. | 313/495 |
| 5,272,413 | 12/1993 | Yamazaki et al. | 313/495 |

FOREIGN PATENT DOCUMENTS

| | | | |
|---|---|---|---|
| 52-50162 | 4/1977 | Japan | 313/495 |
| 56-28445 | 3/1981 | Japan . | |
| 60-97531 | 5/1985 | Japan . | |
| 61-32336 | 2/1986 | Japan . | |
| 61-71538 | 4/1986 | Japan . | |
| 1124936 | 5/1989 | Japan . | |
| 3261024 | 11/1991 | Japan . | |
| 1443577 | 7/1976 | United Kingdom | 313/495 |

OTHER PUBLICATIONS

M. Hartwell, et al., "Strong Electron Emission from Patterned Tin–Indium Oxide Thin Films", International Electron Devices Meeting, pp. 519–521 (1975).

H. Araki, et al., "Electroforming and Electron Emission of Carbon Thin Films", Journal of the Vacuum Society of Japan, vol. 26, No. 1, pp. 22–29.

W.P. Dyke, et al., "Field Emission", Advances in Electronics and Electron Physics, vol. VIII, pp. 90–185 (1956).

G. Dittmer, "Electrical Conduction and Electron Emission of Discontinuous Thin Films", Thin Solid Films, 9, pp. 317–328 (1972).

M. L. Elinson, et al., "The Emission of Hot Electrons and the Field Emission of Electrons From Tin Oxide", Radio Engineering and Electronic Physics, 7, pp. 1290–1296 (Jul. 1965).

C. A. Mead, "Operation of Tunnel–Emission Devices", Journal of Applied Physics, vol. 32, No. 4, pp. 646–652 (Apr. 1961).

C. A. Spindt, et al., "Physical Properties of Thin–Film Field Emission Cathodes with Molybdenum Cones", Journal of Applied Physics, vol. 47, No. 12, pp. 5248–5263 (Dec. 1976).

*Primary Examiner*—Sandra L. O'Shea
*Assistant Examiner*—Matthew J. Esserman
*Attorney, Agent, or Firm*—Fitzpatrick, Cella, Harper & Scinto

[57] ABSTRACT

An image display apparatus comprises an envelope internally provided with at least an electron emitting source, a fluorescent material member that emits light upon irradiation with an electron beam emitted from the electron emitting source and a getter that maintains the vacuum inside the envelope, and a vacuum exhaust tube that forms a vacuum inside the envelope, wherein the inside of the envelope is partitioned with a substrate into a first space having at least the electron emitting source and the fluorescent material member and a second space containing at least the getter, and the substrate has a path that communicates both the spaces.

7 Claims, 4 Drawing Sheets

DISPLAY APPARATUS HAVING FIRST AND SECOND INTERNAL SPACES

BACKGROUND OF THE INVENTION

1. Field of the Invention

The present invention relates to an image display apparatus that displays images by utilizing electron beams.

2. Related Background Art

As flat-plate type display apparatuses, a liquid-crystal display apparatus, EL display apparatus, an and plasma display panels have been hitherto put into practical use. They, however, are on a level unsatisfactory for image display in view or their visual field angle, color display, brightness and so forth. In particular, compared with cathode ray tubes (CRT), there is a great difference in display performance, and they are still not substitutive for the cathode ray tubes.

Meanwhile, as information processing by computers has become higher in grade and television broadcasting has become higher in image quality, there is a rapid increase in a demand for high-precision and large-screen flat-plate type display apparatuses.

Accordingly, several proposals have been made on electron-beam acceleration flat-plate type display apparatuses for their use in image display. For example, as disclosed in U.S. Pat. Nos. 3,408,532 and No. 3,935,499 and Japanese patent Application Laid-open No. 56-28445, such apparatuses comprise a flat-plate type thermal electron emitting source, where an electron beam is emitted from this thermal electron emitting source and is controlled and accelerated by means of a group of control electrodes provided with a number of apertures corresponding with fluorescent material picture elements, with which electron beam a flat fluorescent screen is irradiated so that light is emitted from the desired fluorescent material picture elements.

In place of the above thermal electron emitting source, it is also attempted to produce flat-plate type display apparatus making use of a cold cathode as an electron emitting source.

First, conventionally known cold-cathode electron emitting sources include field emission types (hereinafter abbreviated "FE" types), metal/insulating layer/metal types (hereinafter abbreviated "MIM" types) and surface conduction type electron emitting devices (hereinafter abbreviated "SCE"). Examples of the FE types are disclosed in W. P. Dyke & W. W. Dolan, "Field Emission", Advance in Electron physics, 8, 89 (1956) and C. A. Spindt, "physical properties of Thin-film Field Emission Cathodes with Molybdenum Cones", J. Appl. Phys., 47, 5248 (1976), etc. Examples of the MIM types are disclosed in C. A. Mead, "The Tunnel-emission Amplifier", J. Appl. Phys., 32, 646 (1961), etc. Examples of the SCE types are disclosed in M. I. Elinson, Radio Eng. Electron Phys., 10 (1965), etc.

The SCE types utilize a phenomenon in which emission of electrons takes place by flowing electric currents in parallel to film surface of a thin film with a small area, formed on a substrate. These surface conduction electron emitting devices include those employing an $SnO_2$ film as reported by Elinson et al. mentioned above, those employing an Au thin film as reported in G. Dittmer, "Thin Solid Films", 9, 317 (1972), those employing an $In_2O_3/SnO_2$ film as reported in M. Hartwell & C. G. Fonstad, "IEEE Trans. ED Conf.",519 (1975), and those comprising a carbon thin film as reported in Hisashi Araki et al., "SHINKU (Vacuum)", Vol. 26, No. 1, page 22 (1983).

The present applicants have already proposed a thin type image display apparatus making use of a surface conduction electron emitting device (SCE) as an electron emitting source, where light is emitted by irradiating a fluorescent material with accelerated electron beams to display an image (Japanese Patent Application Laid-open No. 3-261024).

An example of the construction of the flat-plate type image display apparatus employing the cold-cathode electron emitting source as mentioned above will be described below with reference to the accompanying drawing.

FIG. 6 illustrates such a flat-plate type image display apparatus. As shown in FIG. 6, the apparatus is, successively from the back to the front, comprised of a rear plate 61 provided with a plane cold cathode 62, a first spacer 63, an electrode substrate 65 provided with a control electrode 64 that controls electron beam currents and a focusing electrode 66 that focuses electron beams on a fluorescent screen and having apertures at predetermined intervals, a second spacer 67, and a face plate 69 provided with a fluorescent material 68 and an electron beam accelerating electrode. The above constituent members are sealed with a low-melting glass frit at their ends so that the inside components are enveloped in vacuum. Vacuum extraction is carried out through a vacuum exhaust tube 12.

Here, the above first spacer 63 and second spacer 67 are spacers made of electrical insulators, for which glass, ceramic or the like is used. Glass, ceramic or the like is also used in the electrode substrate 65, on both sides of which the control electrode 64 and the focusing electrode 66 are respectively formed by screen printing. In the first and second spacers and the electrode substrate, apertures 65-1, slits 63-1 and 67-1 parallel to plane cold electrodes, and a vacuum exhaust slit 65-2 are respectively formed. These apertures and slit can be made by etching or mechanical working.

The first spacer 63 and the electrode substrate 65 each have a thickness of about 1.0 mm, and the second spacer 67 has a thickness of about 3 to 5 mm for the purpose of a prevention for the discharge between upper and lower substrates.

In the display window board 69, an electron beam accelerating electrode (not shown) and on this electrode an R-G-B fluorescent material and a metal back layer (not shown) are formed. To the accelerating electrode, for example a high voltage of 10 kV to 20 kV is applied. Its inside is thus constructed.

In the display apparatus as described above that requires vacuum extraction of the inside of the apparatus, gettering is carried out in order to maintain the vacuum in the apparatus, which is a process in which a getter serving as a vacuum maintenance member is flashed to deposit the gettering material to the inner surfaces of the image display apparatus.

In this case, the getter is usually provided in the apparatus at its part having no influence on image display, e.g., on its rear plate or side walls. The getter is commonly comprised of gettering material and a metal tube, which gettering material is mainly composed of Ba, and with which gettering material the inside of a metal tube made open in part is filled. The metal tube may have a linear shape or the shape of a ring. The getter is flashed by induction heating or electric heating to deposit the gettering material to the inner surfaces of an image display apparatus, and adsorbs remaining gas to maintain the vacuum in the apparatus.

The pressure inside the image display apparatus whose vacuum exhaust tube has been closed and having the getter is commonly expressed as follows:

$$V\frac{dp}{dt}=Q(t)-pG(t)$$

wherein V is a volume in which the image display apparatus forms a vacuum, p is a pressure of the space in which the image display apparatus forms the vacuum, Q(t) is a quantity of gas released from members inside the image display apparatus, and G(t) is an exhaust velocity of the getter. After adequate lapse of time, the inside pressure becomes substantially constant, and its value is given as follows:

$$P=\frac{Q(t)}{G(t)}$$

The quantity of the gas released from members inside the image display apparatus is proportional to the surface area of the members, and the exhaust velocity of the getter is also proportional to the surface area of the flashed gettering material. It therefore is necessary for the gettering material to have a larger area in order to maintain a vacuum in an image display apparatus having a larger area.

The gettering, however, has been hitherto involved in the following problems.

(1) When the getter as a vacuum maintenance member is deposited on the inner surfaces of the image display apparatus, it is deposited also on members concerned in image display, for example the cold cathode and the control electrodes, resulting in a great deterioration of image quality of display images. In particular, in the case of the cold cathode of the surface conduction type electron emitting devices or the field emission type electron emitting devices, the state of its surface has a great influence on the emission of electrons, and hence is very greatly affected by the deposition of the gettering material. Accordingly, when these electron emitting devices are used, it is necessary to give a space large enough not to be concerned in image display so that such an influence can be avoided as far as possible. This, however, results in a large size of the image display apparatus.

(2) Making the screen larger results in an increase in the inner surface areas inside the image display apparatus and also results in an increase in the area over which the gettering material necessary for maintaining the vacuum inside the image display apparatus is deposited. Hence, the position at which the getter is provided must be taken into account so that the gettering material can be well spread over the necessary inner surfaces of the apparatus. However, partly because of the above problem (1), it has been difficult to ensure a proper position at which the getter is provided.

SUMMARY OF THE INVENTION

Accordingly, the present invention intends to solve the above problems hitherto involved. An object thereof is to provide an image display apparatus that has eliminated the influence of a gettering material on, in particular, the cold cathode and can much better prevent image deterioration such as uneven brightness.

Another object of the present invention is to provide an image display apparatus that can excellently maintain the vacuum inside the apparatus and hence can have a long lifetime even in a large-screen image display apparatus.

According to an aspect of the present invention, there is provided an image display apparatus comprising an envelope internally provided with at least an electron emitting source, a fluorescent material member that emits light upon irradiation with an electron beam emitted from the electron emitting source and a getter that maintains the vacuum inside the envelope, and a vacuum exhaust tube that forms a vacuum inside the envelope, wherein the inside of the envelope is partitioned with a substrate into a first space having at least the electron emitting source and the fluorescent material member and a second space containing at least the getter, and the substrate has a path that communicates both the spaces.

According to another aspect of the present invention, there is provided an image display apparatus comprising an envelope internally provided with at least an electron emitting source and a fluorescent material member that emits light upon irradiation with an electron beam emitted from the electron emitting source, and a vacuum exhaust tube that forms a vacuum inside the envelope, wherein the inside of the envelope is partitioned with a substrate into a first space having at least the electron emitting source and the fluorescent material member and a second space in which a gettering material is deposited on the internal surface thereof, and the substrate has a path that communicates both spaces.

In the above construction, the second space provided with the getter and the first space having the member concerned in image display are partitioned via a member having a path, so that the gettering material is hardly deposited on the member concerned in image display. Hence, as a surface to which the gettering material can be deposited without causing a great deterioration of image quality of display images, it is possible to obtain an area equal to, or larger than, the surface area of the envelope surrounding the space having the image display member, and to provide one or more getters so that the gettering material can be flashed to ensure a sufficient area in which the gettering material is deposited. Moreover, the substrate that forms the electron source may be used as a partition that forms both the spaces, whereby the structure can be made simple and, because of no atmospheric pressure applied to the substrate, the substrate can be made to have a small thickness. Hence, the steps of forming on the substrate the members concerned in image display can be made easily to bring about an improvement in yield and enable cost reduction.

The path that communicates both the spaces may be provided in plurality whereby the conductance in both the spaces can be decreased and the gas released from the inner walls and so forth can be adsorbed on the gettering material with ease, so that a vacuum with a good quality can be maintained.

DETAILED DESCRIPTION OF THE PREFERRED EMBODIMENTS

Figure 1:
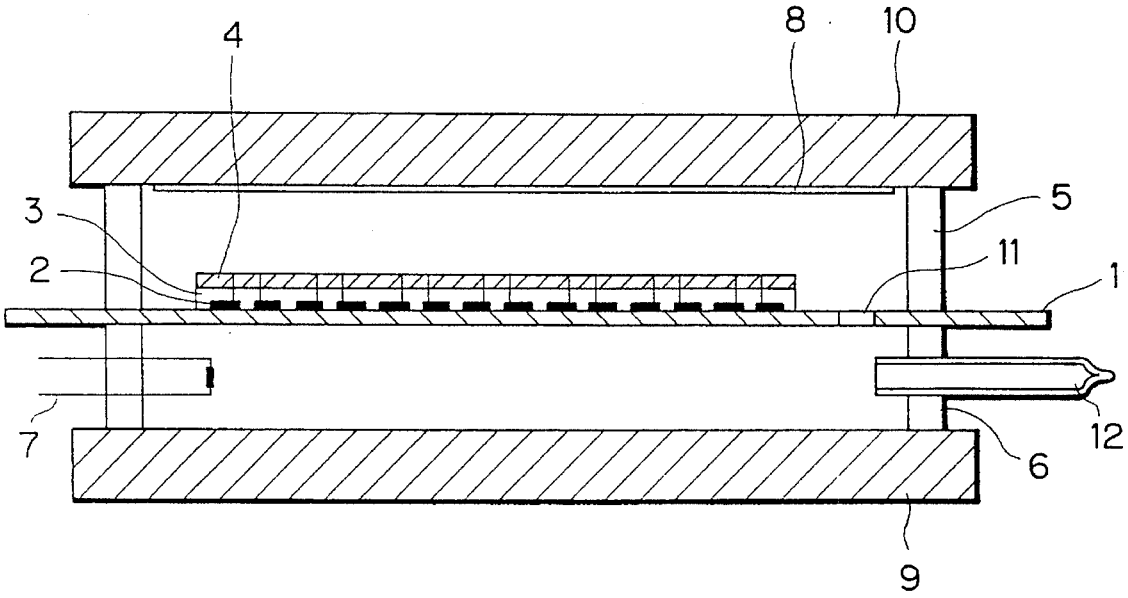
FIG. 1 is a schematic cross section of the image display apparatus according to a first embodiment of the present invention.
Figure 2:
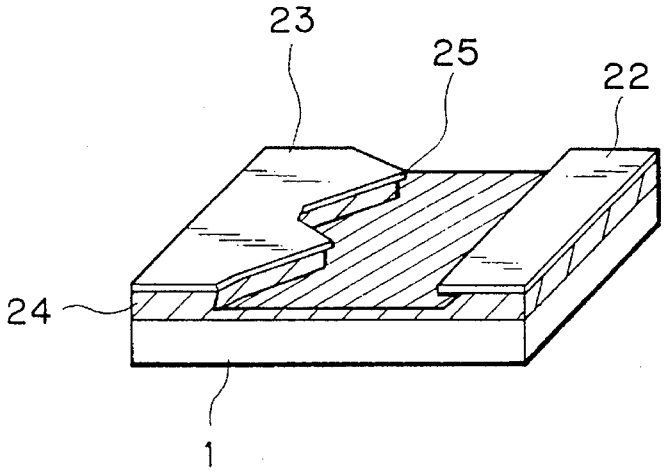
FIG. 2 is a schematic illustration of a field emission type electron emitting device.

First embodiment:

FIG. 1 schematically illustrates the image display apparatus of the present invention in which a field emission type electron emitting device is used as an electron emitting source. In FIG. 1, reference numeral 1 denotes a substrate material serving as an insulating substrate; and 2, a field emission type electron emitting device serving as a plane electron emitting source. FIG. 2 shows the field emission type electron emitting device. In FIG. 2, reference numerals 22 and 23 denotes electrodes for applying voltages; 25, an electron emitting zone having sharp edges, from which electrons are emitted by the action of field electron emission; and 24, an insulator that electrically insulates and supports the electrodes 22 and 23 and the electron emitting zone 25. In the field emission type electron emitting device constructed as shown in FIG. 2, electrons are emitted from the electron emitting zone 25 by the action of field electron emission upon application of a voltage across the electrodes 22 and 23. Referring back to FIG. 1, reference numeral 3 denotes an insulating layer; and 4, a modulating electrode. In the insulating layer 3 and modulating electrode 4, an opening through which electrons pass onto the electron emitting zone 25 is made. Reference numerals 5 and 6 denote outer frames having electrical insulation properties; 7, a getter; 8, a metal-backed fluorescent material; 9, a rear plate; 10, a face plate; 11, a path that communicates the upper and lower spaces partitioned with the substrate material 1; and 12, a vacuum exhaust tube through which the inside of the envelope is vacuum-extracted from the outside.

In the first place, a method of producing the image display apparatus of the present embodiment will be described. First, as the substrate material 1, a soda glass substrate with a plate thickness of 1.1 mm was cleaned, and an $SiO_2$ film was formed thereon by sputtering in a thickness of 5,000 Å. Further thereon, 3,000 Å thick Au films were formed by vacuum deposition and by lithography having a lift-off process to form the electrodes 22 and 23 and the electron emitting zone 25 as shown in FIG. 2, followed by etching using the electrodes and electron emitting zone as masks to fabricate the field emission type electron emitting device shown in FIG. 2. Next, the insulating layer 3 and the modulating electrode 4 were formed. First, as the insulating layer 3, $SiO_2$ was formed into a 2 μm thick film by sputtering, and the modulating electrode 4 formed of a 5,000 Å thick Au thin film and having openings through which electrons can pass was formed by the same method as in the formation of the above field emission type electron emitting device 2, followed by etching of the insulating layer 3 $SiO_2$ using the modulating electrode 4 as a mask to make openings through which electrons are passed.

Here, materials for the electrodes 22 and 23, electron emitting zone 25 and modulating electrode 4 are by no means limited to Au herein used. They may also be conductors such as metal or semiconductors. Materials for the insulating layer 3 and insulator 24 are also by no means limited to $SiO_2$. However, electroconductive materials can be used for the materials as mentioned above. Methods of forming these are also by no means limited to the above methods, and other methods such as printing can give the same effects so long as the structure described above can be formed after all.

Next, the substrate material 1 in which a path 11 with a hole diameter of 5 mm had been made was held between the outer frame 5 made of a 5 mm thick soda glass material and the outer frame 6 having the same thickness and to which the getter 7 and the vacuum exhaust tube 12 had been melt-adhered with a low-melting glass frit. Then the Fear plate 9, made of 6 mm thick soda glass, and the face plate 10 were put together and a low-melting glass frit was coated on the part at which they came into contact, followed by heating at 410° C. for 10 minutes to effect melt sealing. A vacuum-airtight image display apparatus as shown in FIG. 1 was thus produced.

In this embodiment, the number of the getter 7 may not necessarily be one. The getter may be provided in the number necessary for maintaining the vacuum inside the image display apparatus. There are no particular limitations on the shape and number of the path 11 communicating both the spaces. The path may be any of those capable of communicating both the spaces after all. The number of the vacuum exhaust tube may also not necessarily be one, and a plurality of vacuum exhaust tubes may be used as occasion demands.

With regard to the thickness of the outer frames, the outer frames 5 and 6 may not necessarily have the same thickness, and may each have a suitable thickness as occasion demands.

Next, the inside of the image display apparatus was vacuum-extracted to a pressure of not more than $1\times10^{-6}$ Torr through the vacuum exhaust tube 12. Then the vacuum exhaust tube 12 was perfectly closed and the getter 7 was electrified to flash the gettering material. Thus an image display apparatus of the present embodiment was completed.

The shape of the getter in the present embodiment is a linear shape.

The shapes of the getter is by no means limited to the shape in the present embodiment, and the getter may have other shapes such as the shape of a ring. The flashing may also be carried out by induction heating or the like, other than the electric heating used in the present embodiment, and the same effect can be obtained regardless of any particular means so long as the getter can be heated to a temperature high enough to be flashed.

A voltage was applied to the electron source 2 of the image display apparatus of the present embodiment and a modulating signal was given to the modulating electrode, and also a high voltage of about 5 kV was applied to the fluorescent material 8 to display an image. As a result, because of the structure of the present image display apparatus, when the getter 7 was flashed the gettering material was little deposited and had no influence on the members concerned in image display as exemplified by the electron source. Hence, any local uneven brightness was greatly eliminated compared with an image display apparatus in which a getter is provided in the same space as an image display member. The image display apparatus produced in the present embodiment had an image display area of about 86.4 mm×86.4 mm (about 3.4 inches×3.4 inches) and an image display apparatus size of 100 mm×90 mm.

Moreover, in the production step of forming the plane cold cathode 2, the insulating layer 3 and the modulating electrode 4 on the substrate material, it has been very difficult to form them since in the conventional construction both the substrate material 1 and the rear plate 9 are used as one substrate and hence the substrate is required to have a thickness of 5 mm or more on account of a structural resistance to atmospheric pressure, in order to fabricate an image display apparatus comparable to that of the present embodiment. On the other hand, the separate formation of the substrate material 1 and the rear plate 9 makes it possible to form the desired plane cold cathode 2, insulating layer 3 and modulating electrode 4 without any process problem.

As mentioned above, the apparatus size in the present embodiment is 100 mm×90 mm. The larger than this size the area of the image display apparatus is, the more serious the problems in operation, manufacturing process and so forth become, and accordingly, the more effective against such problems the constitution of the present invention as described above becomes.

Figure 3:
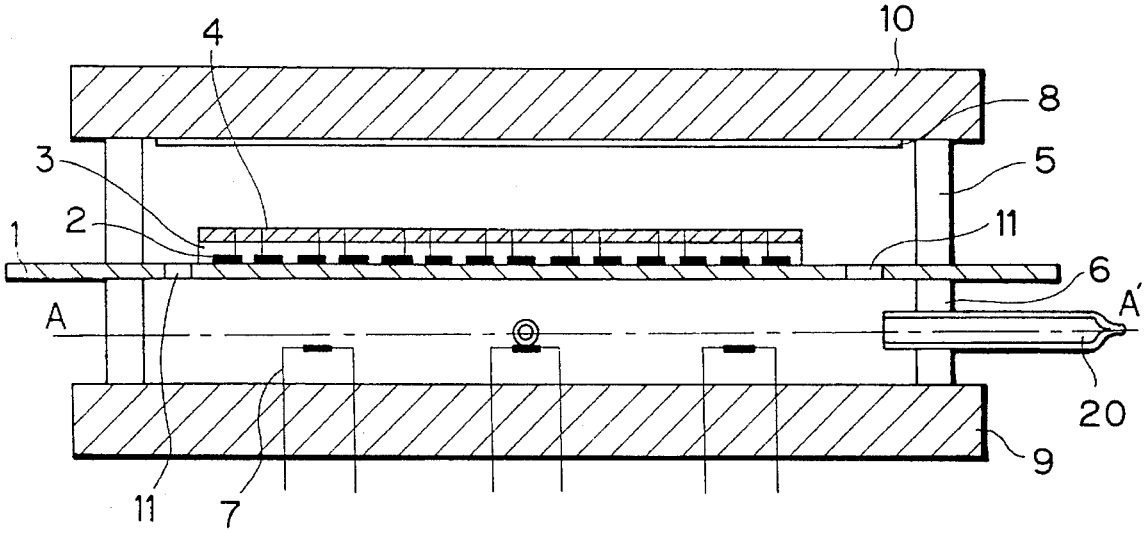
FIG. 3 is a schematic cross section of the image display apparatus according to a second embodiment of the present invention.
Figure 4:
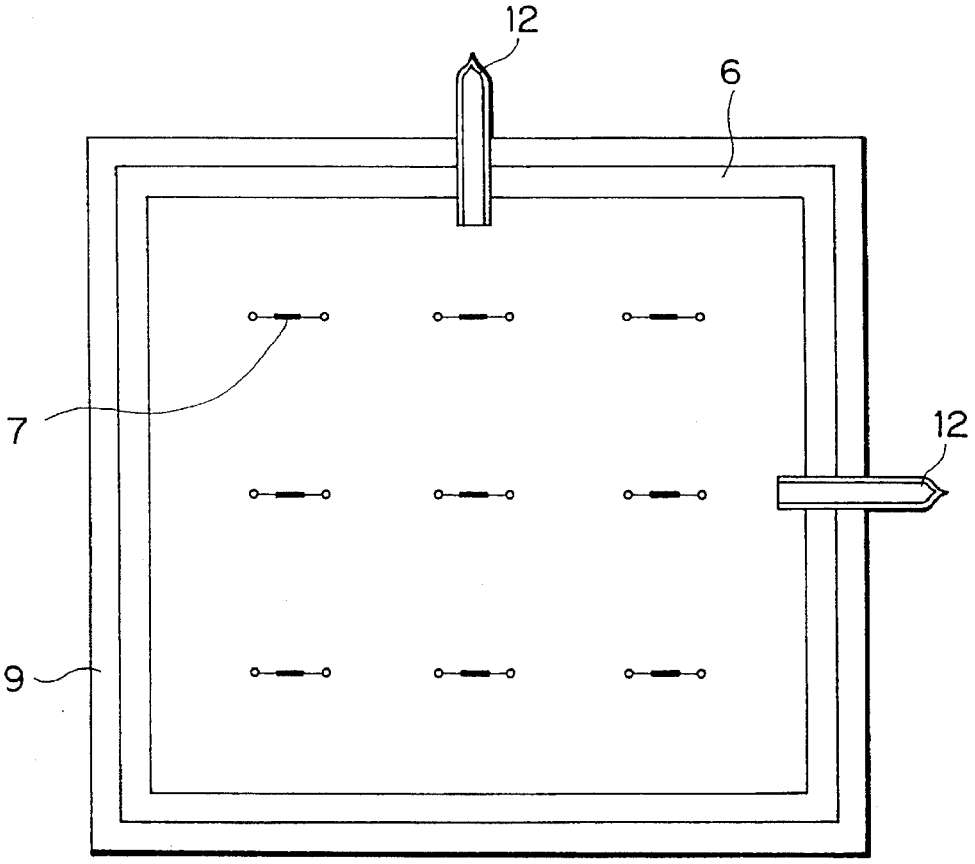
FIG. 4 is a top view of the image display apparatus according to the second embodiment, cut along the line A–A' in FIG. 3.
Figure 5A:
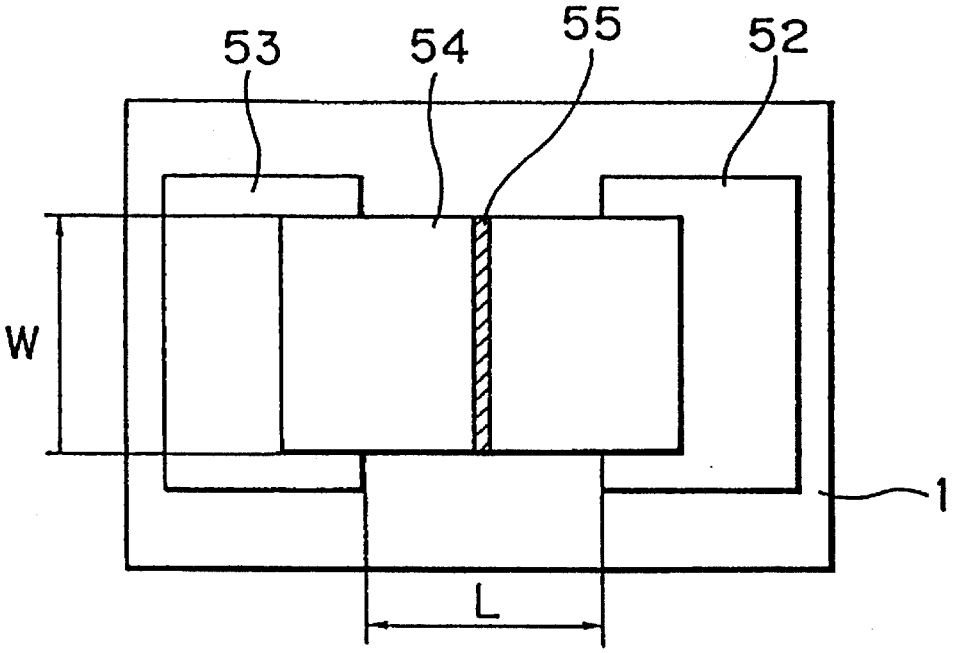
FIGS. 5A and 5B are a top view and a cross section, respectively, of a surface conduction type electron emitting device.
Figure 5B:
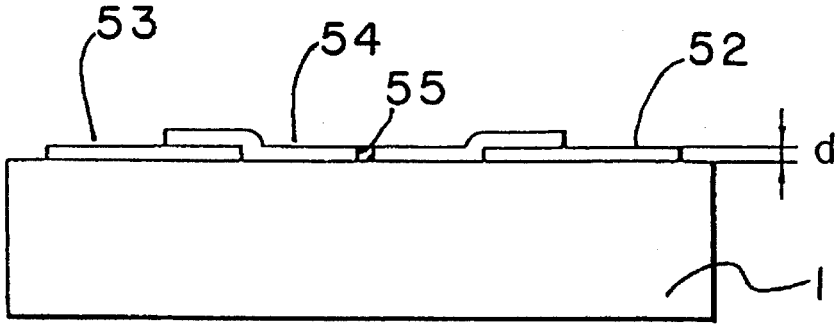
Figure 6:
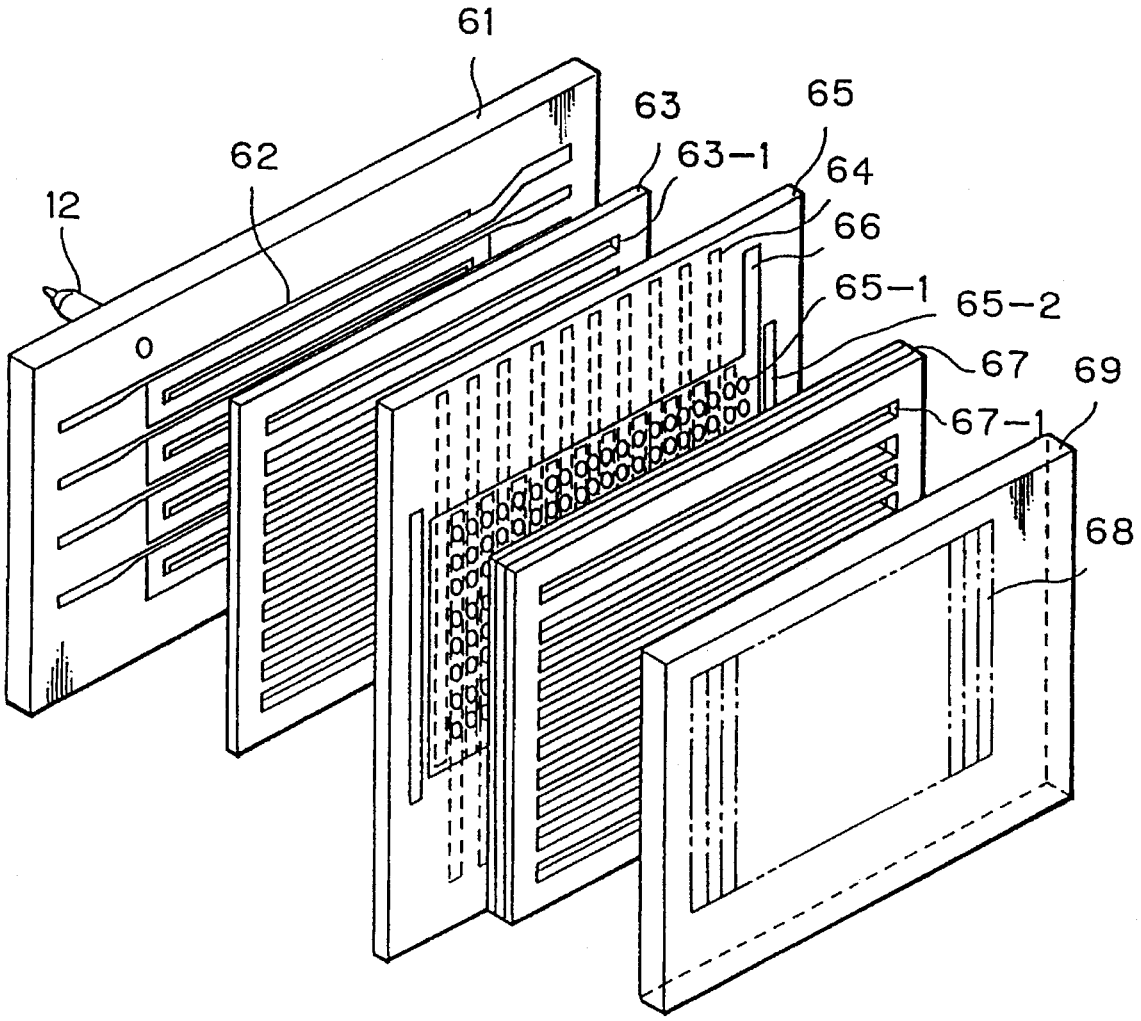
FIG. 6 PRIOR ART
FIG. 6 illustrates the structure of a conventional image display apparatus.

Second embodiment:

FIG. 3 illustrates a second embodiment of the present invention, which is an embodiment of the image display apparatus employing the surface conduction type electron emitting device as an electron emitting source and having a plurality of getters. FIG. 4 is a top view of the apparatus cut along the line A–A' in FIG. 3. In FIGS. 3 and 4, reference numeral 2 denotes a surface conduction type electron emitting device serving as an electron emitting source. Other reference numerals have the same means as in FIG. 1. FIGS. 5A and 5B are a top view (FIG. 5A) and a cross section (FIG. 5B) of the surface conduction type electron emitting device. In FIGS. 5A and 5B, reference numerals 52 and 53 denote electrodes provided apart at a predetermined distance on substrate material; 54, a thin film having an electron emitting zone; and 55, the electron emitting zone. In the thin film 54 having an electron emitting zone 55 in the present invention, the electron emitting zone 55 is comprised of conductive fine particles having a particle diameter of several ten angstroms and the thin film 54 having the electron emitting zone, other than the part denoted by reference numeral 55, is comprised of a fine particle film. Suitable range of diameter of the fine particle is several Å through several thousand Å, and more suitably 10 Å through 200 Å. The fine particle film herein referred to is a film comprising an aggregation of a plurality of fine particles. As a fine structure of the film, the film refers to not only a film in which the fine particles are arranged in an individually dispersed state but also a film in which the fine particles are adjoining to each other or they are overlapping one another (including the form of islands). Alternatively, the thin film 54 having the electron emitting zone may be a carbon thin film in which conductive fine particles are dispersed.

A method of producing the image display apparatus of the present embodiment will be described first. A substrate material 1 of 280 mm×300 mm size and 1.5 mm thick made of soda glass was thoroughly cleaned and thereafter device electrodes 52 and 53 comprised of Ni were formed on the surface of the substrate material 1. At this time, the device electrodes were formed at a distance L of 3 μ m, and these device electrodes were each made to have a width of 500 μ m and a thickness d of 1,000 Å.

To form the thin film 54, an organic metal solution comprising a solution containing an organic palladium (CCP4230, available from Okuno Seiyaku K.K.) was coated, followed by heating at 300° C. for 10 minutes to form a fine particle film comprised of fine particles mainly composed of palladium (average particle diameter: 70 Å). The thin film 54 was thus formed. Here, the thin film 54 was made to have a width (the width of the device) of 300 μ m and positioned as shown in FIG. 5A. This thin film 54 had a layer thickness of about 100 Å and a sheet resistivity of $5\times10^4$ Ω/square.

The organic metal solution herein refers to a solution comprising an organic compound having as a chief element a metal such as Pd, Ru, Ag, Au, Ti, In, Cu, Cr, Fe, Zn, Sn, Ta, W or Pb. Thereafter, the organic metal thin film was heated to carry out baking, followed by lifting-off, etching or the like to make patterning. Thus, the thin film 54 is formed as shown in FIGS. 5A and 5B. Materials for the thin film 54 are by no means limited only to the above examples, which may include metals such as Pd, Ru, Ag, Au, Ti, In, Cu, Cr, Fe, Zn, Sn, Ta, W or Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, carbon, AgMg, NiCu, Pb, and Sn. The thin film 54 having the electron emitting zone may be formed by vacuum deposition, sputtering, chemical Vapor deposition, dispersion coating, dipping OF spinning, any of which can be applied without any particular limitations so long as the thin film can be formed after all.

Next, the insulating layer 3 and the modulating electrode 4 were formed in the same manner as in the first embodiment. First, as the insulating layer 3, $SiO_2$ was formed into a 2 μ m thick film by sputtering, and the modulating electrode 4 formed of a 5,000 Å thick Au thin film and having openings through which electrons can pass was formed by the same method as in the formation of the above field emission type electron emitting device 2, followed by etching of the insulating layer 3 $SiO_2$ using the modulating electrode 4 as a mask to make openings through which electrons are passed.

Next, the substrate material 1, in which paths 11 with a hole diameter of 5 mm had been made at 8 spots, was held between the outer frame 5 made of a 4 mm thick soda glass material and the outer frame 6, having a thickness of 4 mm and to which two vacuum exhaust tubes 12 had been melt -adhered with a low-melting glass frit. Then the rear plate 9, made of 12 mm thick soda glass and to which nine getters 7 had been melt-adhered with a low-melting glass frit, and the face plate 10 were put together and a low-melting glass frit was coated on the part at which they came into contact, followed by heating at 410° C. for 10 minutes to effect melt sealing. The image display apparatus as shown in FIG. 3 was thus produced.

Next, a voltage pulse of triangle wave form (pulse width: 1 msec; pulse cycle: 10 msec; peak value (peak voltage at the time of forming): 5 V) was applied for 60 seconds to conduct energization (forming) to the thin film 54 between electrodes 52 and 53. Thus the electron emitting zone 55 was formed. In the electron emitting zone 55 thus formed, fine particles mainly composed of palladium were arranged in a dispersed state.

The inside of the image display apparatus was vacuum-extracted to a pressure of about $1\times10^{-6}$ Torr through the two vacuum exhaust tubes 12.

Then the vacuum exhaust tubes 12 were perfectly closed and the getters 7 were electrified to flash the gettering material. Thus an image display apparatus of the present embodiment as shown in FIG. 3 was completed.

A voltage was applied to the surface conduction type electron emitting device 2 of the image display apparatus of the present embodiment and a modulating signal was given to the modulating electrode, and also a high voltage of about 10 kV was applied to the fluorescent material 8 to display an image. As a result, the same effects as in the first embodiment were obtained. In addition, although the image display apparatus had a large area, it was possible to obtain an area in which a sufficient gettering material had been deposited, because a plurality of getters were used. Thus, compared with the apparatus having only one getter, the degree of vacuum in the inside little deteriorated and the lifetime was elongated by a factor of several times.

In the first and second embodiments, the field emission type electron emitting device and the surface conduction type electron emitting device are respectively used as electron emitting sources, but the electron emitting sources are by no means limited to these and other electron emitting sources can give similar effects. The electrodes are also by no means limited to the construction of these embodiments and other constructions can also give similar effects.

As described above, according to the present invention, the gettering material has no influence on the image display member, and hence uneven brightness can be eliminated and also the size of the image display apparatus can be made larger. Since also a plurality of getters can be provided, vacuum performance, can be improved to elongate lifetime. Since also the substrate on which members such as the electron emitting source are formed can be made thinner, the apparatus can be handled with ease and their yield can be improved, bringing about a cost reduction. Thus, the present invention is effective for producing thin-type large-screen image display apparatuses with ease.

What is claimed is:

1. An image display apparatus comprising:

an envelope internally provided with at least an electron emitting source, a fluorescent material member that emits light upon irradiation with an electron beam emitted from said electron emitting source and a getter that maintains the vacuum inside said envelope; and a vacuum exhaust tube that forms a vacuum inside said envelope, wherein the inside of said envelope is partitioned with a substrate into a first space having at least said electron emitting source and said fluorescent material member and a second space containing at least said getter, and said substrate has a path that communicates between both the spaces.

2. The image display apparatus according to claim 1, wherein said vacuum exhaust tube is provided in said second space.

3. The image display apparatus according to claim 1, wherein said electron emitting source is provided on said substrate.

4. The image display apparatus according to claim 1, wherein said path that communicates said first space and said second space is provided in plurality.

5. The image display apparatus according to claim 1, wherein a plurality of getters are provided in said second space.

6. The image display apparatus according to claim 1, wherein a plurality of vacuum exhaust tubes are provided in said second space.

7. An image display apparatus comprising;

an envelope internally provided with at least an electron emitting source and a fluorescent material member that emits light upon irradiation with an electron beam emitted from said electron source; and a vacuum exhaust tube that forms a vacuum inside said envelope, wherein the inside of said envelope is partitioned with a substrate into a first space having at least said electron emitting source and said fluorescent material member and a second space in which a gettering material is deposited on the internal surface thereof, and said substrate has a path that communicates between both the spaces.

* * * * *

UNITED STATES PATENT AND TRADEMARK OFFICE

CERTIFICATE OF CORRECTION

PATENT NO. : 5,525,861

DATED : June 11, 1996

INVENTOR(S) : Banno et al.

It is certified that error appears in the above-indentified patent and that said Letters Patent is hereby corrected as shown below: On the title page:

[56] REFERENCES CITED:

FOREIGN PATENT DOCUMENTS
"1124936 5/1989 Japan
3261024 11/1991 Japan" should read
--1-124936 5/1989 Japan
3-261024 11/1991 Japan--.

COLUMN 1:

Line 11, "apparatus," should read --apparatus, an-- and "apparatus, an" should read --apparatus--.

COLUMN 6:

Line 6, "Fear" should read --rear--.

COLUMN 7:

Line 28, "material;" should read --material 1;--.

COLUMN 8:

Line 16, "Vapor" should read --vapor--.
Line 17, "OF" should read --or--.

UNITED STATES PATENT AND TRADEMARK OFFICE

CERTIFICATE OF CORRECTION

PATENT NO. : 5,525,861 Page 2 of 2

DATED : June 11, 1996

INVENTOR(S) : Banno et al.

It is certified that error appears in the above-indentified patent and that said Letters Patent is hereby corrected as shown below:

COLUMN 10:

Line 20, "comprising;" should read --comprising:--.

Signed and Sealed this

Twenty-third Day of June, 1998

Bruce Lehman

*Attest:*

BRUCE LEHMAN

*Attesting Officer*

*Commissioner of Patents and Trademarks*